US012540428B2

(12) United States Patent
Okamura et al.

(10) Patent No.: US 12,540,428 B2
(45) Date of Patent: Feb. 3, 2026

(54) INDUSTRIAL SEWING MACHINE AND INFORMATION TERMINAL

(71) Applicant: JUKI CORPORATION, Tokyo (JP)

(72) Inventors: Masami Okamura, Tokyo (JP); Yuta Abe, Tokyo (JP); Genichirou Awano, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 18/522,185

(22) Filed: Nov. 28, 2023

(65) Prior Publication Data

US 2024/0175177 A1 May 30, 2024

(30) Foreign Application Priority Data

Nov. 29, 2022 (JP) ..... 2022-190731

(51) Int. Cl.
*D05B 19/08* (2006.01)
*D05B 19/00* (2006.01)
*D05B 19/10* (2006.01)

(52) U.S. Cl.
CPC ..... *D05B 19/08* (2013.01); *D05B 19/006* (2013.01); *D05B 19/10* (2013.01)

(58) Field of Classification Search
CPC ..... D05B 19/02; D05B 19/04; D05B 19/06; D05B 19/08; D05B 19/10; D05B 19/105; D05B 19/006
USPC ..... 700/136–138
See application file for complete search history.

(56) References Cited

U.S. PATENT DOCUMENTS 5,662,055 A * 9/1997 Hartwig ..... D05B 19/04 112/102.5
5,970,894 A * 10/1999 Mase ..... D05B 19/02 112/102.5
6,196,146 B1 * 3/2001 Goldberg ..... D05B 19/10 705/26.1
6,216,618 B1 * 4/2001 Goldberg ..... D05B 19/105 112/155
6,813,535 B2 * 11/2004 Akira ..... D05B 19/04 112/102.5
6,889,111 B2 * 5/2005 Tomita ..... D05B 19/10 705/26.1
7,685,072 B2 * 3/2010 Hirata ..... G06Q 90/00 700/137
8,276,531 B2 * 10/2012 Tashiro ..... D05C 5/04 112/102.5
8,588,954 B2 * 11/2013 Goldman ..... D05C 5/02 700/138

(Continued)

FOREIGN PATENT DOCUMENTS

DE 112020002347 2/2022
JP 2022007031 1/2022

OTHER PUBLICATIONS

"Search Report of Europe Counterpart Application", issued on Apr. 4, 2024, p. 1-p. 8.

*Primary Examiner* — Danny Worrell
(74) *Attorney, Agent, or Firm* — JCIPRNET

(57) ABSTRACT

The industrial sewing machine includes: a web server, based on a request from a web browser installed on an information terminal, providing the web browser with an operation screen simulating an operation panel, and receiving operation data generated by operating the operation screen; and a sewing machine control part, controlling a sewing machine operating part based on the operation data.

9 Claims, 5 Drawing Sheets

(56) References Cited

U.S. PATENT DOCUMENTS

| | | | |
|---|---|---|---|
| 2012/0245727 | A1 | 9/2012 | Naka et al. |
| 2022/0307179 | A1 | 9/2022 | Kamihira |

* cited by examiner

INDUSTRIAL SEWING MACHINE AND INFORMATION TERMINAL

CROSS-REFERENCE TO RELATED APPLICATIONS

This application claims the priority benefit of Japan Application No. 2022-190731, filed on Nov. 29, 2022. The entirety of the above-mentioned patent application is hereby incorporated by reference herein and made a part of this specification.

BACKGROUND

Technical Field

A technology disclosed in the present specification relates to an industrial sewing machine and an information terminal.

Related Art

A technology is known in which a home appliance may be operated or a state of a home appliance may be monitored through an information terminal. Japanese Patent Laid-open No. 2022-007031 discloses a technology in which the number of times of use of an electric toilet seat-integrated toilet or the like is monitored through a mobile terminal. In Japanese Patent Laid-open No. 2022-007031, by accessing a server using a mobile terminal having a dedicated application program (so-called app) installed thereon, a user is able to monitor the number of times of use of the electric toilet seat-integrated toilet or the like through the mobile terminal.

It is being considered to operate an industrial sewing machine through an information terminal. There are multiple types of industrial sewing machines depending on the purpose. In many cases, multiple industrial sewing machines of multiple types are provided in one sewing factory. In the case of operating an industrial sewing machine through an information terminal having an app installed thereon, there is a possibility that it may become necessary to install as many apps on the information terminal as there are types of industrial sewing machines. While the number of apps installed on the information terminal can be reduced if an app is developed that is capable of operating multiple types of industrial sewing machines, a great deal of effort and cost may be required to develop an app capable of operating multiple types of industrial sewing machines.

SUMMARY

An industrial sewing machine includes: a web server, based on a request from a web browser installed on an information terminal, providing the web browser with an operation screen simulating an operation panel, and receiving operation data generated by operating the operation screen; and a sewing machine control part, controlling a sewing machine operating part based on the operation data.

DESCRIPTION OF THE EMBODIMENTS

A technology disclosed in the present specification includes operating an industrial sewing machine through an information terminal without having to install many apps on the information terminal.

The present specification discloses an industrial sewing machine. The industrial sewing machine includes: a web server, based on a request from a web browser installed on an information terminal, providing the web browser with an operation screen simulating an operation panel, and receiving operation data generated by operating the operation screen; and a sewing machine control part, controlling a sewing machine operating part based on the operation data.

According to the technology disclosed in the present specification, the industrial sewing machine can be operated through the information terminal without having to install many apps on the information terminal.

Hereinafter, an embodiment according to the disclosure will be described with reference to the drawings, but the disclosure is not limited thereto. The components of the embodiment described below can be combined as appropriate. Some components may not be used.

Industrial Sewing Machine

Figure 1:
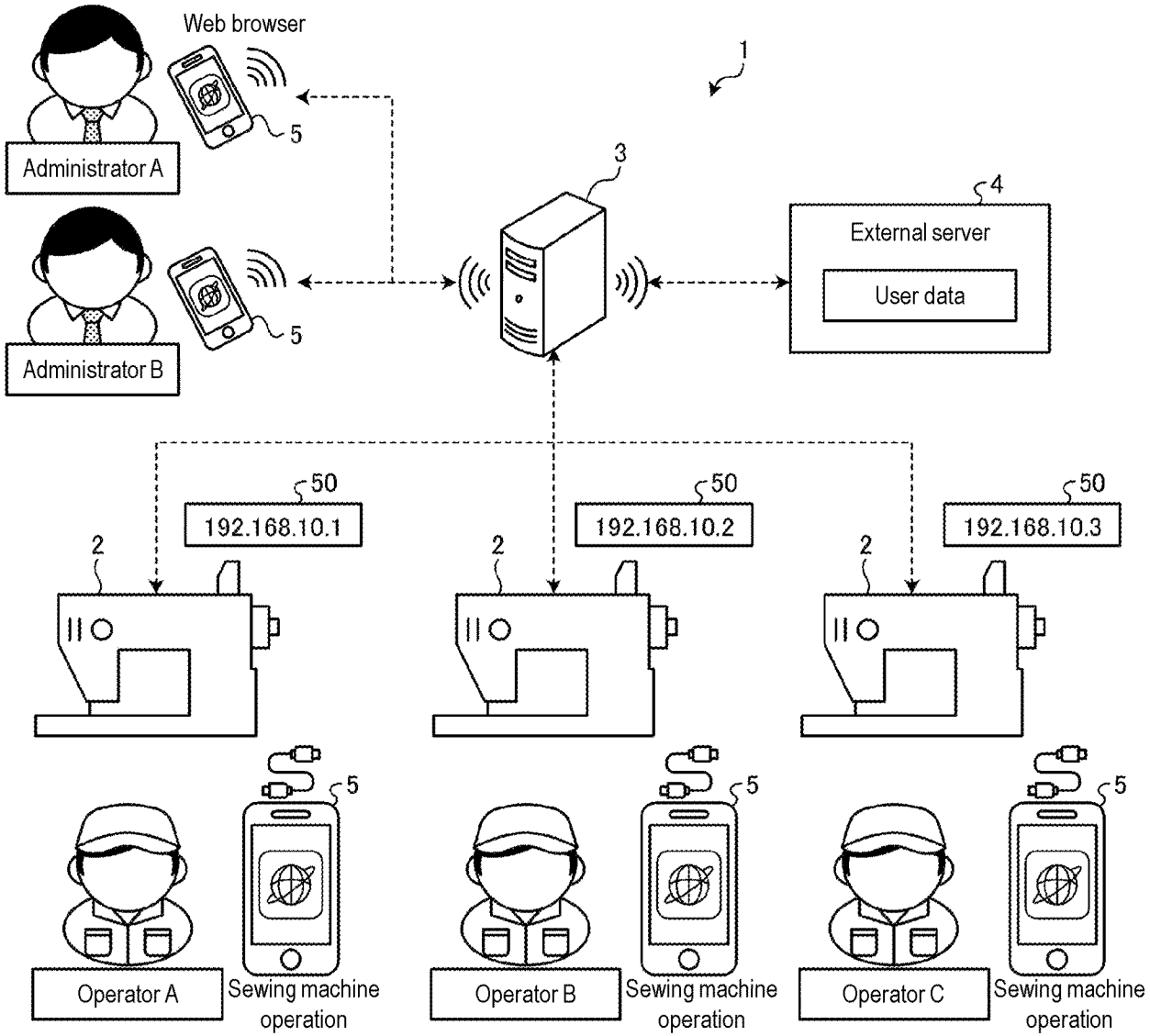
FIG. 1 schematically illustrates a sewing factory in which an industrial sewing machine according to an embodiment is provided.

FIG. 1 schematically illustrates a sewing factory 1 in which an industrial sewing machine 2 according to an embodiment is provided. The industrial sewing machine 2 is provided in the sewing factory 1. A plurality of industrial sewing machines 2 are provided in the sewing factory 1. The industrial sewing machine 2 operates in a sewing factory. By sewing fabric with thread by the industrial sewing machine 2, a sewn product is produced. Examples of the sewn product include clothing. In the sewing factory 1, a sewn product is produced by a plurality of industrial sewing machines 2. A plurality of types of industrial sewing machines 2 are provided in the sewing factory 1 depending on the purpose. In the sewing factory 1, a plurality of types of industrial sewing machines 2 are provided so as to correspond to each of a plurality of processes for producing the sewn product. Examples of types of the industrial sewing machine 2 include a lockstitch sewing machine for sewing together the body, a button sewing machine for attaching buttons to the body, and a pocket sewing machine for attaching pockets to the body. A large number and wide variety of industrial sewing machines 2 are provided in one sewing factory 1. To simplify the description, three industrial sewing machines 2 are illustrated in FIG. 1. A plurality of industrial sewing machines 2 of one type may be provided in the sewing factory 1.

An administrator and an operator work at the sewing factory 1. The administrator manages the operator and the industrial sewing machine 2. The operator operates the industrial sewing machine 2 and performs sewing processing. The administrator and the operator are users of the industrial sewing machine 2. There may be one administrator or multiple administrators. In an example illustrated in FIG. 1, the administrator includes an administrator A and an administrator B. There may be multiple operators or one operator. In the example illustrated in FIG. 1, the operator includes an operator A, an operator B, and an operator C.

As illustrated in FIG. 1, the industrial sewing machine 2 constructs a network in the sewing factory 1 by using a router 3, an external server 4, and an information terminal 5.

The router 3 is a communication device that relays communication between the industrial sewing machine 2, the external server 4, and the information terminal 5. The router 3 is provided in the same facility where the industrial sewing machine 2 is provided. That is, the router 3 is provided in the sewing factory 1. Examples of the router 3 include a wireless local area network (LAN) router.

The external server 4 is shared by a plurality of industrial sewing machines 2 in the sewing factory 1. The external server 4 stores user data pertaining to a user who operates the information terminal 5. The user data includes operator data pertaining to the operator who operates the industrial sewing machine 2, customization data pertaining to setting of a display screen displayed on a display device of the information terminal 5, and operation log data indicating an operation history of the user.

The external server 4 is provided in the same facility where the industrial sewing machine 2 is provided. That is, the external server 4 is provided in the sewing factory 1. The external server 4 may be a cloud server that provides a service in the form of cloud computing. Each of the industrial sewing machine 2 and the information terminal 5 communicates with the external server 4 via the router 3. Each of the industrial sewing machine 2 and the information terminal 5 is able to acquire the user data from the external server 4.

The information terminal 5 is carried by each of the administrator and the operator. The information terminal 5 is lent from the sewing factory 1 to each of the administrator and the operator. The information terminal 5 is a portable electronic device such as a smartphone or a tablet personal computer. The information terminal 5 may also be a stationary electronic device such as a desktop personal computer.

A web browser is installed on the information terminal 5. The user accesses a web server via the web browser installed on the information terminal 5. Based on a request from the web browser, the web server provides the web browser with a web page screen. In the embodiment, the web page screen provided from the web server to the web browser includes an operation screen simulating an operation panel of the industrial sewing machine 2. The operation screen is displayed on a display device of the information terminal 5. By operating the operation screen displayed on the display device of the information terminal 5, the operator is able to operate the industrial sewing machine 2.

Figure 2:
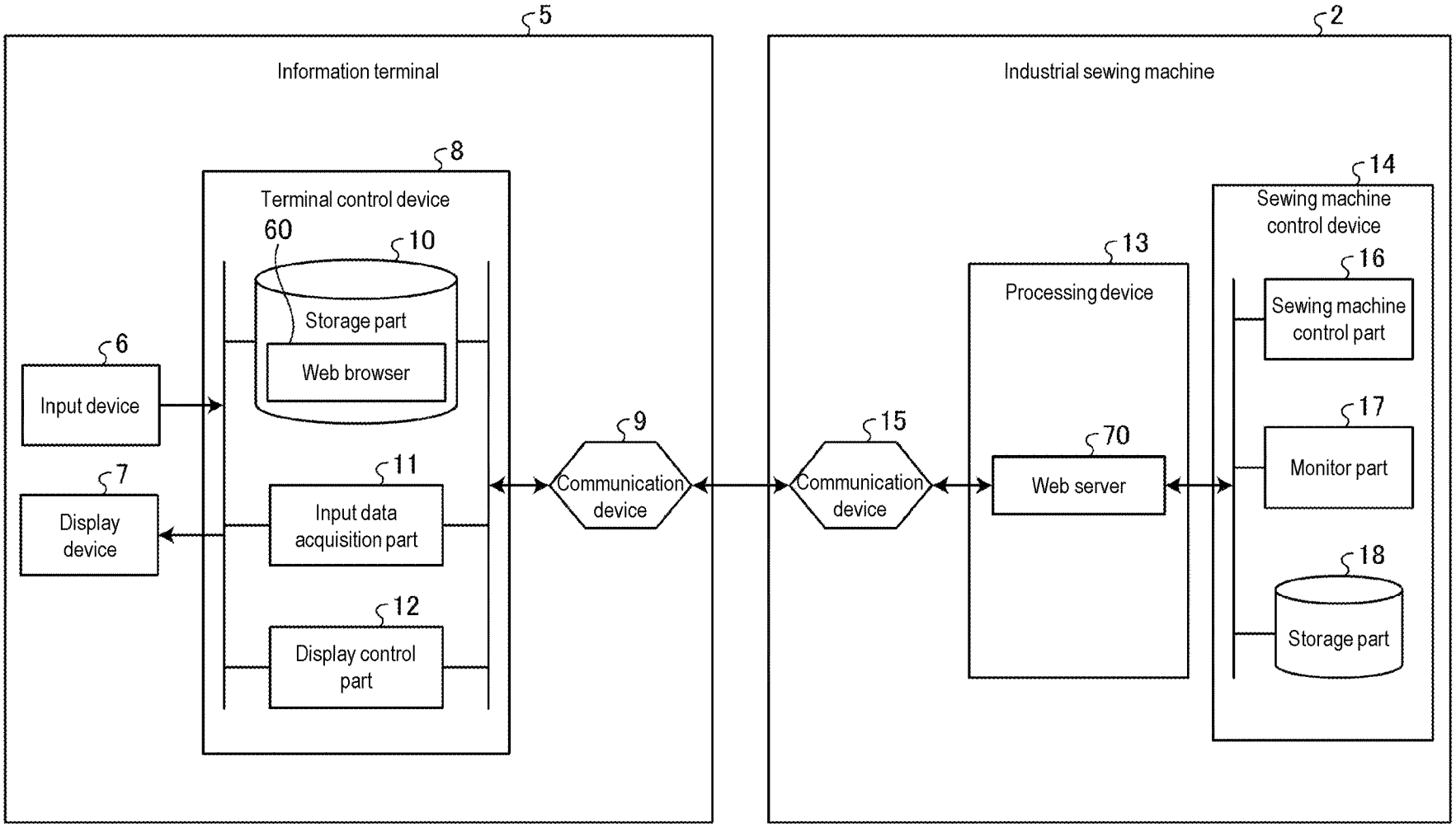
FIG. 2 is a block diagram illustrating an industrial sewing machine and an information terminal according to an embodiment.

FIG. 2 is a block diagram illustrating the industrial sewing machine 2 and the information terminal 5 according to an embodiment. As illustrated in FIG. 2, the information terminal 5 includes an input device 6, a display device 7, a terminal control device 8, and a communication device 9. Due to operation by the user, the input device 6 generates input data. The input data generated in the input device 6 is input to the terminal control device 8. Examples of the input device 6 include a touch panel. The input device 6 may include a camera that is able to read a two-dimensional (2D) barcode. The display device 7 displays the display screen. Examples of the display device 7 include a flat panel display such as a liquid crystal display (LCD) or an organic electroluminescence display (OELD). The terminal control device 8 includes a computer system. The terminal control device 8 includes a processor such as a central processing unit (CPU), a main memory including a nonvolatile memory such as a read only memory (ROM) and a volatile memory such as a random access memory (RAM), a storage, and an interface including an input/output circuit. The communication device 9 communicates with the industrial sewing machine 2.

The industrial sewing machine 2 includes a processing device 13, a sewing machine control device 14, and a communication device 15. Each of the processing device 13 and the sewing machine control device 14 includes a computer system. Each of the processing device 13 and the sewing machine control device 14 includes a processor such as a central processing unit (CPU), a main memory including a nonvolatile memory such as a read only memory (ROM) and a volatile memory such as a random access memory (RAM), a storage, and an interface including an input/output circuit. The communication device 15 communicates with the information terminal 5.

The terminal control device 8 includes a storage part 10, an input data acquisition part 11, and a display control part 12. The storage part 10 stores a web browser 60 (web browser application). The input data acquisition part 11 acquires the input data from the input device 6. The display control part 12 causes the display device 7 to display the display screen.

The processing device 13 includes a web server 70. The web server 70 is a computer program or computer system that, based on a request from the web browser 60 installed on the information terminal 5, provides the web browser 60 with the operation screen simulating the operation panel of the industrial sewing machine 2. The web server 70 receives operation data generated by operating the operation screen at the information terminal 5.

The sewing machine control device 14 includes a sewing machine control part 16, a monitor part 17, and a storage part 18. Based on the operation data from the web server 70, the sewing machine control part 16 outputs a control command to control the industrial sewing machine 2. The sewing machine control part 16 controls a sewing machine operating part based on the operation data. Examples of the sewing machine operating part include a motor included in the industrial sewing machine 2, and a needle bar and a thread take up that are operated by power generated by the motor. The monitor part 17 monitors an operating condition for the industrial sewing machine 2. Examples of the operating condition for the industrial sewing machine 2 include thread tension, pressing pressure on the fabric, and shape (stitch shape) of a seam formed on the fabric. The industrial sewing machine 2 is provided with a sensor that detects the operating condition for the industrial sewing machine 2. Examples of the sensor include a tension sensor that detects the thread tension and a pressing pressure sensor that detects the pressing pressure on the fabric. By acquiring data detected by the sensor, the monitor part 17 is able to monitor the operating condition for the industrial sewing machine 2. The industrial sewing machine 2 is provided with a motor for operating the needle bar and the thread take up. By acquiring a drive signal of the motor, the monitor part 17 is able to monitor the operating condition for the industrial sewing machine 2. The storage part 18 stores the operating condition for the industrial sewing machine 2 monitored by the monitor part 17. The operating condition for the industrial sewing machine 2 stored in the storage part 18 includes a present state operating condition and a historical operating condition. The present state operating condition indicates the operating condition for the industrial sewing machine 2 at present. The historical operating condition indicates the operating condition for the industrial sewing machine 2 in the past.

The industrial sewing machine 2 and the information terminal 5 communicate through the communication device 15 and the communication device 9. The communication device 15 of the industrial sewing machine 2 receives the operation data from the information terminal 5. The industrial sewing machine 2 and the information terminal 5 may communicate wirelessly or via a cable. Examples of the cable include a Universal Serial Bus (USB) cable. One end of the cable is connected to a connection terminal such as a USB terminal provided in the industrial sewing machine 2. The other end of the cable is connected to a connection terminal such as a USB terminal provided in the information terminal 5. In the case where the communication device 15 of the industrial sewing machine 2 receives the operation data from the information terminal 5 via the cable, a control command that causes the sewing machine operating part to operate is output from the sewing machine control part 16. In the case where the communication device 15 of the industrial sewing machine 2 receives the operation data from the information terminal 5 wirelessly, no control command is output from the sewing machine control part 16, and the operation of the sewing machine operating part is prohibited.

The web server 70 transmits a parameter indicating the operating condition held by the sewing machine control part 16 to the router 3 or the information terminal 5. The information terminal 5 transmits the operation data to the web server 70 via the router 3 or a USB cable connected to the information terminal 5. The web server 70 transmits the operation data received from the information terminal 5 to the sewing machine control part 16. The operation data for operating the industrial sewing machine 2 includes a motor control command, a parameter change command, and a sewing machine operation mode change command for the industrial sewing machine 2.

Operation

Figure 3:
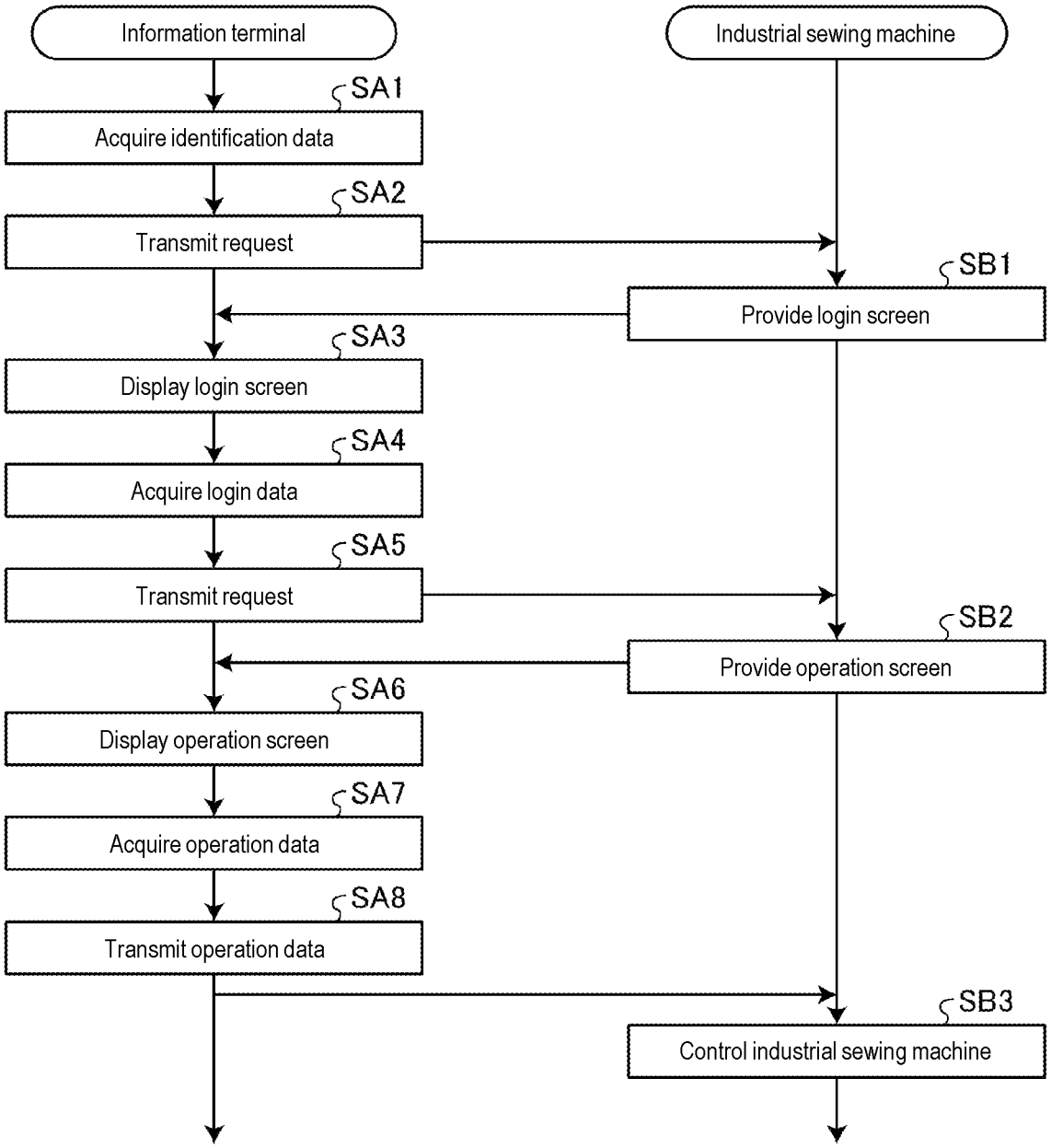
FIG. 3 is a flowchart illustrating an operation of an industrial sewing machine according to an embodiment.

FIG. 3 is a flowchart illustrating an operation of the industrial sewing machine 2 according to an embodiment. FIG. 3 illustrates a procedure for the operator to operate the industrial sewing machine 2 through the information terminal 5.

In order to operate the industrial sewing machine 2 through the information terminal 5, the operator inputs, to the terminal control device 8 via the input device 6, identification data of the industrial sewing machine 2 to be operated. As illustrated in FIG. 1, in the case where mutually different IP addresses 50 are assigned as the identification data of the industrial sewing machine 2 to each of a plurality of industrial sewing machines 2, the operator inputs the IP address 50 with the input device 6 (touch panel). In the case where mutually different 2D barcodes are attached as the identification data of the industrial sewing machine 2 to each of a plurality of industrial sewing machines 2, the operator reads the 2D barcode with the input device 6 (camera). The information terminal 5 and the industrial sewing machine 2 may be connected by a USB cable, and the identification data of the industrial sewing machine 2 may be transmitted to the information terminal 5 via the USB cable. The input data acquisition part 11 of the terminal control device 8 acquires the identification data of the industrial sewing machine 2 from the input device 6 (step SA1). Based on the identification data from the input device 6, the web browser 60 transmits a request to the web server 70. The web browser 60 requests the web server 70 to provide a login screen (step SA2).

Based on the request from the web browser 60, the web server 70 provides the web browser 60 with the login screen (step SB1).

Figure 4:
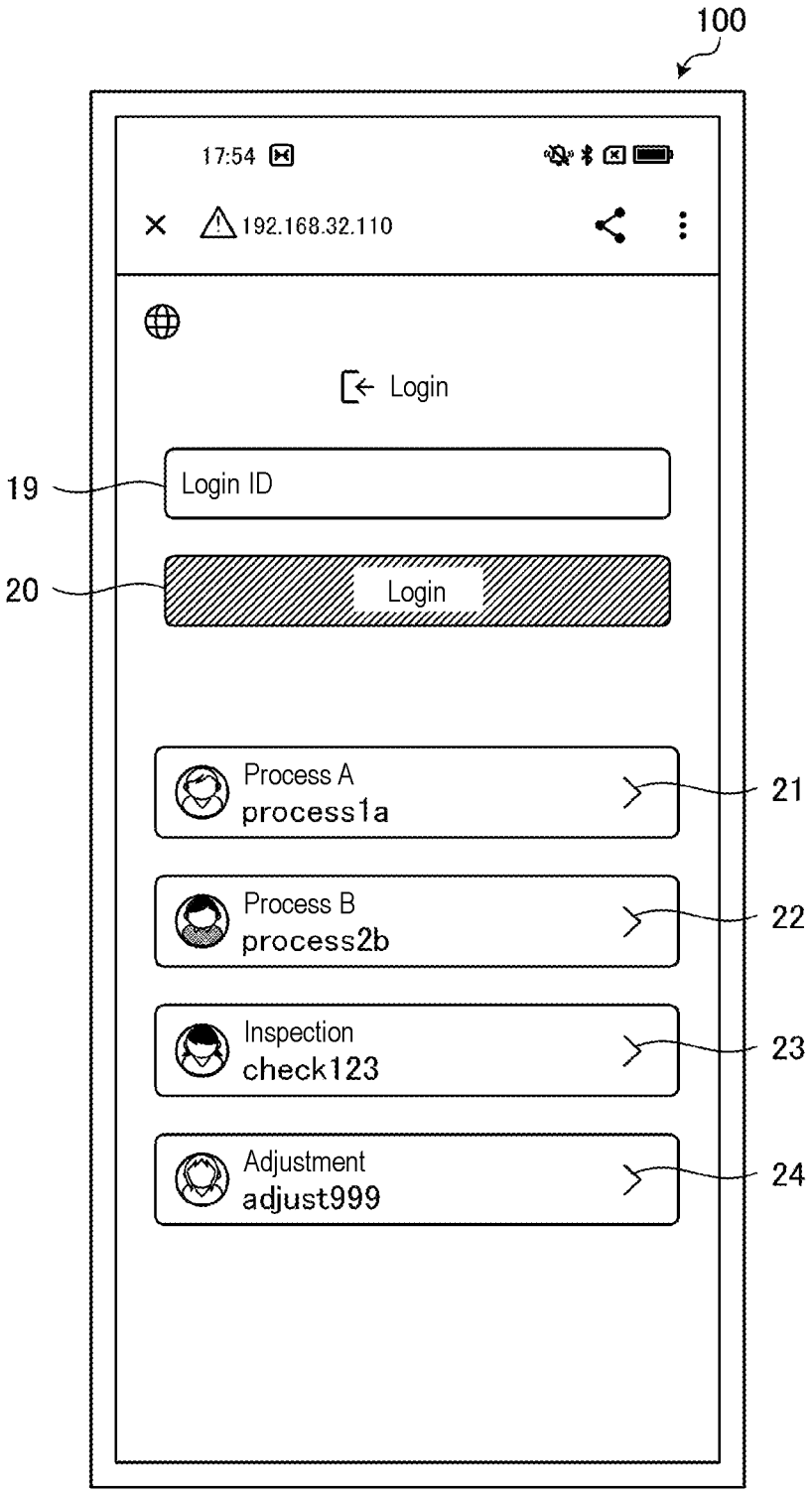
FIG. 4 illustrates a login screen according to an embodiment.

FIG. 4 illustrates a login screen 100 according to an embodiment. As described above, in the sewing factory 1, a plurality of industrial sewing machines 2 are provided so as to correspond to each of a plurality of processes for producing the sewn product. Examples of the industrial sewing machine 2 provided in the sewing factory 1 include a lockstitch sewing machine for sewing together the body, a button sewing machine for attaching buttons to the body, and a pocket sewing machine for attaching pockets to the body. The web server 70 provides the web browser 60 with the login screen 100 for selecting a specific process from a plurality of processes. The display control part 12 causes the display device 7 to display the login screen 100 provided to the web browser 60 (step SA3).

As illustrated in FIG. 4, the login screen 100 includes: an input space 19 for a login ID; a login button 20; a first symbol 21, indicating process A which is a first process; a second symbol 22, indicating process B which is a second process; a third symbol 23, indicating inspection which is a third process; and a fourth symbol 24, indicating adjustment which is a fourth process.

The operator operates the input device 6 and selects, from the first, second, third and fourth processes, a process to be performed using the industrial sewing machine 2. For example, if process A which is the first process is selected, the operator inputs to the input space 19 the login ID corresponding to process A, and then taps the login button 20. Accordingly, login data for logging in to process A is generated as the input data. The input data acquisition part 11 of the terminal control device 8 acquires from the input device 6 the login data generated by operating the login screen 100 (step SA4). Based on the login data from the input device 6, the web browser 60 transmits a request to the web server 70. The web browser 60 requests the web server 70 to provide an operation screen (step SA5).

Based on the request from the web browser 60 generated by operating the login screen 100, the web server 70 provides the web browser 60 with an operation screen 200. The web server 70 provides the web browser 60 with the operation screen 200 based on process A (step SB2).

Figure 5:
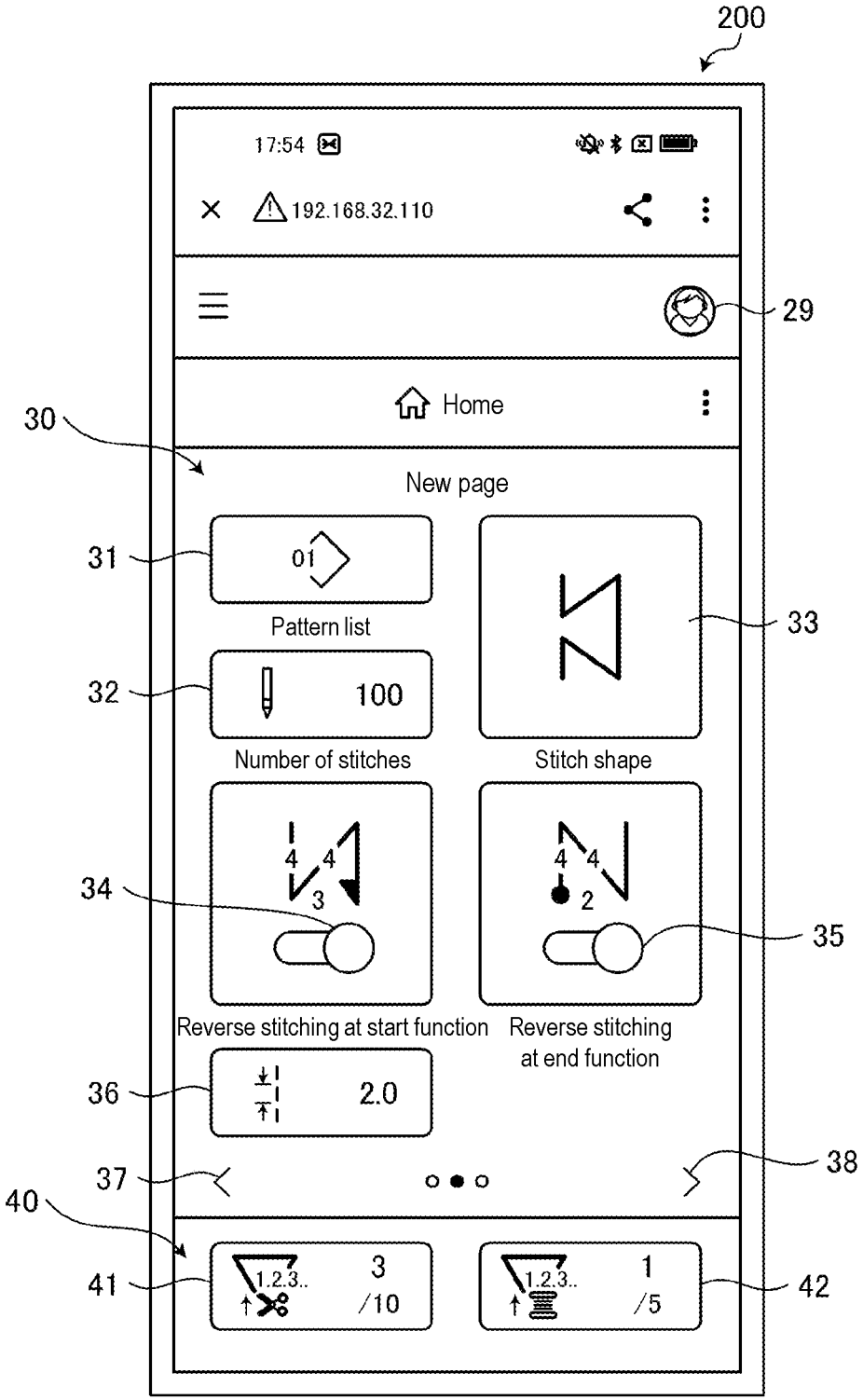
FIG. 5 illustrates an operation screen according to an embodiment.

FIG. 5 illustrates the operation screen 200 according to an embodiment. The web server 70 provides the web browser 60 with the operation screen 200 simulating the operation panel of the industrial sewing machine 2. The web browser 60 receives the operation screen 200 from the web server 70. The display control part 12 causes the display device 7 to display the operation screen 200 provided to the web browser 60 (step SA6).

As illustrated in FIG. 5, the operation screen 200 includes a symbol 29 for specifying process A, a movable screen 30, and a fixed screen 40. The movable screen 30 is turned over by operating a screen movement button 37 or a screen movement button 38. The movable screen 30 includes: a pattern list symbol 31; a counting symbol 32, indicating the number of reciprocations of a sewing machine needle; a stitch shape symbol 33, indicating a selected stitch shape; a selection button 34, enabling or disabling a reverse stitching at start function; a selection button 35, enabling or disabling a reverse stitching at end function; and a sewing pitch button 36, for selecting a sewing pitch. The fixed screen 40 includes: a thread cutting symbol 41, indicating the number of times of thread cutting; and a bobbin symbol 42, indicating the number of times of bobbin replacement.

The operator operates the input device 6 and selects an operating condition for the industrial sewing machine 2. The input data acquisition part 11 of the terminal control device 8 acquires from the input device 6 the operation data generated by operating the operation screen 200 (step SA7). The web browser 60 transmits to the web server 70 the operation data from the input device 6 that is generated by operating the operation screen 200 (step SA8).

The web server 70 transmits the operation data from the web browser 60 of the information terminal 5 to the sewing machine control device 14. The operation data is transmitted from the information terminal 5 to the sewing machine control part 16 via the web server 70. The sewing machine control part 16 controls the industrial sewing machine 2 based on the operation data (step SB3).

Customization of Operation Screen

The web server 70 is able to customize the operation screen 200 based on a process for producing a sewn product. The web server 70 is able to provide, for example, the operation screen 200 suitable for process A, the operation screen 200 suitable for process B, the operation screen 200 suitable for inspection, and the operation screen 200 suitable for adjustment.

The web server 70 is able to customize the operation screen 200 based on the user data pertaining to the user. The web server 70 is able to provide the operation screen 200 based on, for example, the operator data pertaining to the operator A. The operator A is able to operate the input device 6 and customize the operation screen 200.

The operation screen 200 displayed on the display device 7 may be customized by the user operating the operation screen 200. Due to operation of the operation screen 200, the web server 70 generates the customization data for customizing the operation screen 200. The customization data may be stored in the storage part 18 or the external server 4.

Effects

As described above, the industrial sewing machine 2 according to an embodiment includes: the web server 70, based on the request from the web browser 60 installed on the information terminal 5, providing the web browser 60 with the operation screen 200 simulating the operation panel of the industrial sewing machine 2, and receiving the operation data generated by operating the operation screen 200; and the sewing machine control part 16, controlling the sewing machine operating part of the industrial sewing machine 2 based on the operation data received by the web server 70. According to embodiment, the industrial sewing machine 2 can be operated through the information terminal 5 and the web server 70 without having to install many apps on the information terminal 5.

Other Embodiments

In the embodiment described above, the user data is stored in the external server 4. The external server 4 may be omitted. The user data may be stored in the storage part 18 of each of a plurality of industrial sewing machines 2.

What is claimed is:

1. An industrial sewing machine comprising:

a web server, based on a request from a web browser installed on an information terminal, providing the web browser with an operation screen simulating an operation panel for producing a sewn product, and receiving operation data generated by operating the operation screen; and a sewing machine control part, controlling a sewing machine operating part to perform a sewing operation based on the operation data, wherein the web server provides the web browser with a login screen for selecting a specific process from a plurality of processes for producing the sewn product and inputting a login ID corresponding to the selected specific process, and, based on a request generated by operating the login screen, provides the operation screen, wherein the plurality of processes comprise a sewing process, an inspection process or an adjustment process.

2. The industrial sewing machine according to claim 1, wherein the operation data is transmitted from the information terminal to the sewing machine control part via the web server.

3. The industrial sewing machine according to claim 2, further comprising:

a communication device, receiving the operation data.

4. The industrial sewing machine according to claim 3, wherein, in a case where the communication device receives the operation data via a cable, a control command that causes the sewing machine operating part to operate is output from the sewing machine control part; and in a case where the communication device receives the operation data wirelessly, an operation of the sewing machine operating part is prohibited.

5. The industrial sewing machine according to claim 1, wherein the web server customizes the operation screen based on a process for producing a sewn product.

6. The industrial sewing machine according to claim 1, wherein the web server customizes the operation screen based on user data pertaining to a user.

7. The industrial sewing machine according to claim 5, wherein, due to operation of the operation screen, customization data for customizing the operation screen is generated; and the industrial sewing machine further comprises a storage part that stores the customization data.

8. The industrial sewing machine according to claim 6, wherein, due to operation of the operation screen, customization data for customizing the operation screen is generated; and the industrial sewing machine further comprises a storage part that stores the customization data.

9. The industrial sewing machine according to claim 1, wherein user data pertaining to a user is acquired from an external server shared in a sewing factory.

* * * * *